US006572760B2

(12) United States Patent
Whitmore

(10) Patent No.: US 6,572,760 B2
(45) Date of Patent: Jun. 3, 2003

(54) CATHODIC PROTECTION

(76) Inventor: David Whitmore, 38 Kings Dr., Winnipeg, Manitoba (CA), R3T 3E5

( * ) Notice: Subject to any disclaimer, the term of this patent is extended or adjusted under 35 U.S.C. 154(b) by 31 days.

(21) Appl. No.: 09/910,931

(22) Filed: Jul. 24, 2001

(65) Prior Publication Data

US 2002/0023848 A1 Feb. 28, 2002

Related U.S. Application Data

(63) Continuation-in-part of application No. PCT/CA00/00101, filed on Feb. 2, 2000, which is a continuation-in-part of application No. 09/245,373, filed on Feb. 5, 1999, now Pat. No. 6,165,346.

(51) Int. Cl.[7] ..... C23F 13/00

(52) U.S. Cl. ..... 205/734; 204/196.1; 204/196.17; 204/196.18; 204/196.19; 204/196.3; 204/280; 204/288; 204/288.5; 205/740; 205/730

(58) Field of Search ..... 205/734; 204/196.1, 204/196.17, 196.18, 196.19, 196.3, 280, 288, 288.5

(56) References Cited

U.S. PATENT DOCUMENTS

| | | | | |
|---|---|---|---|---|
| 4,265,725 A | | 5/1981 | Tatum | |
| 5,183,694 A | | 2/1993 | Webb | |
| 5,292,411 A | | 3/1994 | Bartholomew et al. | |
| 5,431,795 A | | 7/1995 | Moreland | |
| 5,609,748 A | | 3/1997 | Kotowski | |
| 5,968,399 A | | 10/1999 | Clear | |
| 5,986,339 A | | 11/1999 | Clear | |
| 6,022,469 A | * | 2/2000 | Page | 205/734 |
| 6,033,553 A | | 3/2000 | Bennett | |
| 6,165,346 A | * | 12/2000 | Whitmore | 205/734 |
| 6,303,017 B1 | * | 10/2001 | Page et al. | 205/734 |
| 6,332,971 B1 | * | 12/2001 | Hill | 205/734 |

FOREIGN PATENT DOCUMENTS

| | | |
|---|---|---|
| WO | WO92/01824 | 2/1992 |
| WO | WO94/29496 | 12/1994 |
| WO | WO98/16670 | 4/1998 |

OTHER PUBLICATIONS

Norcure brochure "Is Salt Induced Corrosion Causing Problems with your Concrete Structures?" No month/year available.

Vector brochure "The Concrete Restoration and Protection Specialists" No month/year available.

Norcure brochure "Changing the face of concrete repair" No month/year available.

* cited by examiner

*Primary Examiner*—Bruce F. Bell
(74) *Attorney, Agent, or Firm*—Adrian D. Pattison; Michael R. Williams; Ryan W. Dupuis

(57) ABSTRACT

Cathodic protection of a structure including a steel member at least partly buried in a covering layer, such as steel rebar in a concrete structure, is provided by embedding sacrificial anodes into the concrete layer at spaced positions over the layer and connecting the anodes to the rebar. Each anode is inserted into a drilled hole in the layer and is electrically attached to the rebar in the same or an adjacent hole by a steel pin which is attached to the reinforcement by arc welding or by impact. In the arrangement where the anode and the attachment are in the same hole, the pin passes into or through the anode so as to hold the anode rigidly within the hole. The hole is filled by a settable filler material. In order to maintain effective current conduction from the anode to the reinforcement through the filler and the concrete over an extended period to maintain the required protection, there is added to the filler, to a covering layer on the anode body or to the anode body itself a first material to hold the pH at the anode in a preferred range of the order of 12 to 14 and a second humectant material to absorb moisture.

50 Claims, 7 Drawing Sheets

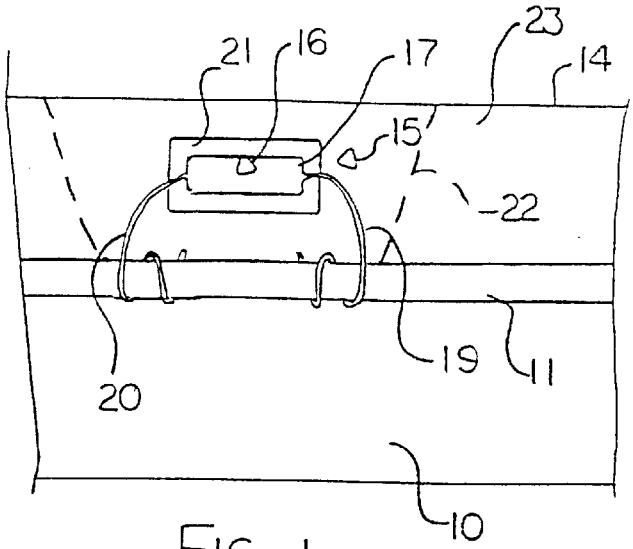
FIG. 1
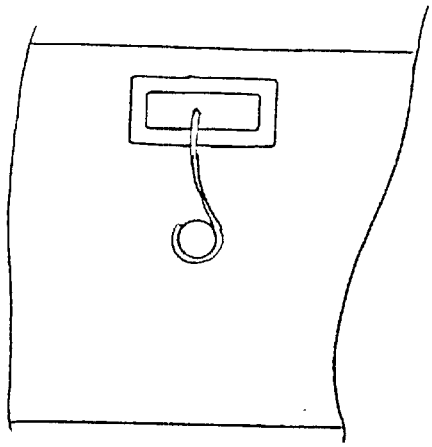
FIG. 2
FIG. 3
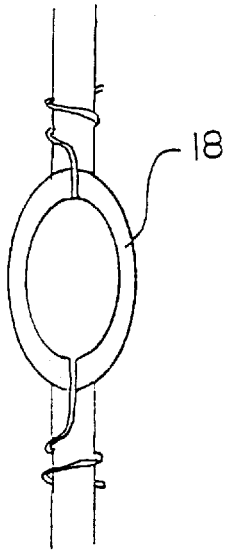

Anode Blocks Current Output Over Time
(Designation: Humectant/Alkali)

CATHODIC PROTECTION

This application is a continuation-in-part application of PCT application Ser. No. PCT/CA00/00101 filed Feb. 2, 2000 (published Aug. 10, 2000 under publication No. WO 00/46422) which is a continuation-in-part application of application Ser. No. 09/245,373 filed Feb. 5, 1999 and now issued on Dec. 26, 2000 as U.S. Pat. No. 6,165,346.

This invention relates to a method for cathodic protection which is particularly but not exclusively arranged for use with reinforced concrete and to an anode construction for use with a method of cathodic protection.

BACKGROUND OF THE INVENTION

Cathodic protection of steel elements at least partly embedded in a surrounding layer is well known. This is primarily used for protection of large structures such as pipe lines or drilling rigs in a corrosive environment. However proposals have been made for cathodic protection of reinforcing elements in concrete structures where the effect of the cathodic protection may be much more localized and may not act to protect the steel reinforcement as a whole.

It is also known that corrosion of steel in concrete can be reduced or halted by generating movement of ions within the concrete structure between an anode and a cathode defined by the conventional metal reinforcing members within the concrete. Techniques are available for cathodic protection in which sufficient current is generated to maintain an ongoing protection and for restoration in which the current is used for a relatively short time but at a sufficient value to cause restorative effects.

Various restorative effects can be obtained including particularly the extraction of chloride ions from the concrete which would otherwise cause corrosion of the metal reinforcement leading to degradation of this structure and spalling of the concrete material covering the reinforcing members. In this method an electrolyte is carried in a porous material between the outside surface of the concrete and the anode.

Examples of this method are shown and described in detail in a brochure by Norcure Chloride Removal Systems Inc. entitled "Is Salt Induced Corrosion Causing Problems with your Concrete Structures", in a brochure by Vector Construction entitled "The Concrete Restoration and Protection Specialists" and in a brochure by "Fosroc/NCTAS" entitled "Norcure Desalination". These brochures describe a technique which is used for various concrete structures including bridge decks and the brochure by Fosroc shows particularly a technique in which a bridge deck is restored using this anodic method.

In the brochure and as generally used in practice, after the concrete surface is exposed by removal of any covering layers, a porous material is laid down onto the upper surface and this receives an electrolyte. The porous material is then covered by a mesh type electrode in the form of wire netting which is then covered by a further layer of the porous material.

A current supply is connected between the mesh anode and the reinforcing steel of the concrete and over an extended period of many weeks this acts to cause the transfer of ions from the concrete material through the electrolyte to provide a restorative effect.

The increased usage of salt as a de-icing agent in freezing conditions has severely exacerbated the problem of chloride degradation of concrete structures in climates where freezing conditions can be expected. Also the presence of salt in a marine environment can generate similar degradation.

Restoration of concrete using a temporary current is an entirely different process from impressed current cathodic protection. In the latter process, a small current typically of the order of 1–10 mAmps/sq meter is caused to flow continuously through the life of the concrete for the purpose of inhibiting corrosion.

The current used in the restoration process is strictly temporary for a period of the order of 20 to 90 days and has a value which is of the order of 50 to 200 TIMES that of the continuous current. Thus the current in the restoration process may lie in the range 0.4 to 3.0 Amps/sq meter. In addition, the process of restoration must include a liquid electrolyte whereas the continuous process is typically dry. Therefore the types of anode and materials to be used are of an entirely different character.

In PCT Published Application WO94/29496 of Aston Material Services Limited is provided a method for cathodically protecting reinforcing members in concrete using a sacrificial anode such as zinc or zinc alloy. In this published application and in the commercially available product arising from the application, there is provided a puck-shaped anode body which has a coupling wire attached thereto. In the commercially available product there are in fact two such wires arranged diametrically opposed on the puck and extending outwardly therefrom as a flexible connection wire for attachment to an exposed steel reinforcement member.

The puck is surrounded by an encapsulating material such as mortar which holds an electrolyte that will sustain the activity of the anode. The mortar is compatible with the concrete so that electrolytic action can occur through the mortar into and through the concrete between the anode and the steel reinforcing member.

The main feature of the published application relates to the incorporation into the mortar of a component which will maintain the pH of the electrolyte in the area surrounding the anode at a high level of the order of 12 to 14.

In use of the device, a series of the anodes is provided with the anodes connected at spaced locations to the reinforcing members. The attachment by the coupling wire is a simple wrapping of the wire around the reinforcing bar. The anodes are placed in locations adjacent to the reinforcing bars and re-covered with concrete to the required amount.

Generally this protection system is used for concrete structures which have been in place for some years sufficient for corrosion to start. In general, areas of damage where restoration is required are excavated to expose the reinforcing bars whereupon the protection devices in the form of the mortar-covered puck are inserted into the concrete as described above and the concrete refilled.

These devices are beginning to achieve some commercial success and are presently being used in restoration processes. However improvements in operation and ergonomics are required to improve success of this product in the field.

In International Publication W098/16670 of Bennett and Clear is disclosed another cathodic protection system intended to be used as a surface arrangement. This arrangement relates to a thinly sprayed zinc or zinc alloy which is applied onto the surface of the concrete. This zinc or zinc coating is then used as an anode to supply current for the cathodic protection process. As the anode is exposed at the surface, this may be used either as a sacrificial system in which there is no applied current and the anode is gradually corroded as the electrolytic process proceeds or as an impressed current cathodic protection system.

The improvement of the above Bennett application relates to the application of a humectant in free-flowing form which is positioned at or near the interface between the zinc anode coating and the concrete surface. It has been found and is disclosed in this application that the provision of the humectant in free-flowing form acts to absorb moisture from the area above the surface. The humectant is defined in the application as being either deliquescent or hygroscopic where a deliquescent material is one which becomes moist or liquefied after exposure to humid air and a hygroscopic material is defined as one which is capable of absorbing moisture from the atmosphere. The humectant is delivered to or near the interface of the anode by application as a solution which is aqueous, colloidal or in an organic solvent such as alcohol. When the humectant in solution is applied to the surface of the anode, it is transported to or near the interface by capillary action. The application states that the humectant is applied to the exposed surface of the anode coating and therefore the anode coating must be sufficiently thin or otherwise arranged to be porous to allow the humectant to reach the interface.

U.S. Pat. No. 4,265,725 (Tatum) assigned to CE Equipment and issued May 5, 1981 discloses an arrangement for making a rigid connection between an anode and an electrical connector therefor.

U.S. Pat. No. 5,609,748 (Kotowski) assigned to Heraeus Elektroden and issued Mar. 11, 1997 discloses an anode arrangement to be buried within a concrete structure to provide cathodic protection.

U.S. Pat. No. 5,431,795 (Moreland) assigned to Thoro Systems Products and issued Jul. 11, 1995 discloses a cathodic protection system which uses an alkaline buffer to prevent acid build up for use with an electrically conductive coating on a concrete structure.

U.S. Pat. No. 6,193,857 (Davison) assigned to Foseco discloses an anode body in the form of a puck coated with a mortar in which the puck is attached by ductile wires to the rebar within an excavation in the concrete.

SUMMARY OF THE INVENTION

It is one object of the present invention, therefore to provide an improved method for cathodic protection.

According to a first aspect of the invention there is provided a method for cathodic protection comprising:

providing a covering material and a steel member at least partly embedded in the covering material;

providing a sacrificial anode body in the form of a solid body separate from the covering material;

electrically connecting the anode body to the steel member so that an electrical potential therebetween causes an electrical current to flow therebetween through the electrical connection and causes ions to flow through an interface of the anode body and through the covering material tending to inhibit corrosion of the steel member;

and providing a material which is bound into the anode body so as to be carried thereby or which is bound into a material surrounding the anode body so as to be carried thereby which acts in the presence of moisture to communicate ions at the interface of the anode body to keep the interface electrochemically active during the life of the anode body to maintain said cathodic protection, where the anode body is covered by the covering material and/or the material surrounding the anode body;

and providing in the material the characteristic of a humectant and causing the presence of the humectant material to absorb additional moisture sufficient to maintain conductivity at the interface to a level greater than would occur in the absence of the humectant material.

Preferably the humectant material is carried in a manner which allows a surface of the material of the anode body to communicate ions and which presents the humectant material at the surface of the anode body.

The humectant material is one example only of enhancement materials which will effect an enhancement of the ion communication over an extended period. These can include but are not limited to the alkali described in more detail hereinafter.

In one alternative, the anode body itself carries the humectant, or other enhancement material, which is incorporated into the anode body. The incorporation can be effected as an admixture or commingled with the zinc or other sacrificial material as it is cast in molten form. Otherwise the material can be incorporated by techniques such as dividing the material of the anode and the humectant, or other enhancement material, and admixing the divided materials into a solid integral body by sintering or pressure or other suitable method. Yet further, the enhancing material can be encapsulated with the anode material by folding or rolling the material into a foil of the anode material. The mixture is effected so that the above condition applies at the finished surface of the anode body. Normally the enhancement material will be a salt or an organic polymer and not an element and not a metal. It is not intended therefore that the term "enhancement material" used herein should include metals or other elements which are used in an alloy with the sacrificial material of the anode. Thus the enhancement material is admixed or commingled with the sacrificial anode material either mechanically or in a molten state of the anode material and not in an alloying process.

In another alternative, the anode body comprises a core body of a sacrificial material and a layer permanently attached to at least one outer surface of the core body thus defining an anode member separate from the covering material for embedding in the covering material, the layer being arranged to allow communication of ions through the covering material between the core body of the anode member and the steel member and wherein the humectant material is bound into the layer as a mixture therewith. Preferably the layer is a solid such as a cementitious material cast on the outside of the sacrificial anode body.

Preferably the anode body is buried in the covering material so as to be wholly embedded therein. This can be achieved by excavating within the existing structure and filling the excavation after the anode is inserted. Alternatively the anode can be covered or buried by applying onto an existing layer of concrete a covering layer. Thus the anode may be only partly buried in the original concrete or may be wholly outside the original concrete and thus may be covered by the new concrete applied. In this way, in some cases, no excavation of the original material may be necessary. The additional concrete can be applied by attaching a suitable form, for example a jacket similar to that shown in U.S. Pat. No. 5,714,045 (Lasa et al) issued Feb. 3, 1998. The form shown in this patent is particularly designed for columns but other arrangements could be designed for other structures. The anode shown in this patent is replaced by the anodes disclosed hereinafter.

Preferably the humectant material is a solid.

Preferably the method includes the steps of forming at least one hole in the covering layer, preferably by drilling since only a relatively small hole is required, so as to expose the steel member therein, inserting the anode body into the hole, attaching the anode body to the steel member and at least partially filling the hole.

In a yet further alternative, the method includes the steps of forming at least one hole in an existing layer of covering material so as to expose the member therein, inserting the anode body into the hole or one of the holes, electrically connecting the anode body to the steel member in the hole or another hole and at least partially filling the hole with a filler material separate from the anode body and wherein the humectant material is contained in the filler material as a mixture therewith.

Preferably the method includes providing a material which is bound into the anode body so as to be carried thereby or which is bound into a material surrounding the anode body so as to be carried thereby which provides at least at the surface of the anode body a pH greater than 12 and preferably greater than 14.

Preferably the anode body is electrically connected to the steel member by a solid pin rigidly attached to the steel member.

In one alternative, the pin has one end driven into the steel member by an impact tool.

In another alternative, the pin has one end electrically welded to the steel member.

In a yet further alternative, the anode member is electrically connected to the reinforcing member by a connecting member having a flowable metal portion attached to the anode member by forces causing the flowable portion to flow.

In one arrangement which is particularly of advantage where the thickness of the concrete layer is relatively thin, said at least one hole includes a first and a second hole, wherein the anode member is inserted into the first hole, wherein the second hole is in communication with a steel member and wherein an electrical connection from the anode member is rigidly attached to the steel member in the second hole.

The pin may include at least a portion extending into the anode body either wholly or partly through the body in the longitudinal direction.

According to a second aspect of the invention there is provided a method for cathodic protection of a concrete structure comprising:

providing an existing concrete structure having a steel member and a layer of concrete covering the steel member so as to define a surface of the concrete layer spaced from the steel member;

providing a sacrificial anode member in the form of a solid body separate from the concrete layer;

forming at least one hole in the existing layer of concrete so as to expose a steel member therein;

inserting the anode member into the at least one hole;

and electrically connecting the anode member to the exposed steel member;

the anode body being electrically connected to the steel member so that an electrical potential therebetween causes an electrical current to flow therebetween through the electrical connection and causes ions to flow through the concrete layer tending to inhibit corrosion of the steel member wherein the at least one hole is formed by drilling and the anode member is shaped for insertion into the at least one drilled hole.

In one alternative, the anode member may be shaped and dimensioned so that when inserted into the hole it has a cylindrical outer surface which is a tight fit on the wall of the drilled hole. This can be achieved by providing a diameter which matches or slightly exceeds that of the hole so that the anode member is driven into the hole. Alternatively, the member may be dimensioned as a free sliding fit within the drilled hole and is expanded into a tight fit within the drilled hole. This can be done by impact forces or pressure acting to drive the anode member into the hole or by otherwise expanding the anode member for example by an insert driven into the anode member. In a further alternative, the anode member may be driven into place by a tool shaped to match the top or exposed face but which includes a pattern in relief which forms an embossed pattern in the face to confirm to the installer that sufficient force has been applied to drive the member to the required position and to bottom it against the rebar, and if necessary to expand into a tight fit.

In this arrangement, the anode member may include an electrical connector at the bottom end and the electrical connector is driven into connection with the steel member by said driving forces.

According to a third aspect of the invention there is provided an anode member for use in cathodic protection of a steel member in a covering material, the anode member comprising:

a solid anode body separate from the covering material formed by a sacrificial anode material;

an electrical connecting member for electrical connection to the steel member;

and an enhancement material for co-operating with the sacrificial anode material in enhancing the communication of ions between the covering material and the anode material, wherein the enhancement material is bound into the sacrificial anode material of the solid anode body so as to be carried thereby.

In one preferred arrangement, the enhancement material and the sacrificial anode material, such as zinc, in divided form are pressed together to form a porous body. This arrangement has the advantage that corrosion products from corrosion of the zinc anode body are received into pores of the porous zinc body.

According to a fourth aspect of the invention there is provided an anode member for use in cathodic protection of a steel member in a covering material, the anode member comprising:

a solid anode body separate from the covering material formed by a sacrificial anode material;

an electrical connecting member for electrical connection to the steel member;

wherein the electrical connection includes a solid member rigidly connected with the anode body so as to be exposed at a bottom surface of the anode body, the solid member being arranged for rigid attachment to the steel member.

According to a fifth aspect of the invention there is provided a method for cathodic protection comprising:

providing a covering material and a steel member at least partly embedded in the covering material;

providing a sacrificial anode member in the form of a solid body separate from the covering material;

embedding the anode body in the covering material;

and electrically connecting the anode member to the steel member;

the anode body being electrically connected to the steel member so that an electrical potential therebetween causes an electrical current to flow therebetween through the electrical connection and causes ions to flow through the covering material tending to inhibit corrosion of the steel member wherein the anode body is formed of a sacrificial anode material which is arranged to define a porous body having pores therein;

and preventing expansion of the anode body during corrosion by arranging the pores in size and number such that corrosion products from corrosion of the anode body are received into the pores.

BRIEF DESCRIPTION OF THE DRAWINGS

One embodiment of the invention will now be described in conjunction with the accompanying drawings in which:

FIG. 1 is a cross sectional view showing schematically a method for restoration of concrete according to the present invention.

FIG. 2 is a cross sectional view at right angles to that of FIG. 1.

FIG. 3 is a top plan view of the embodiment of FIGS. 1 and 2.

DETAILED DESCRIPTION

Figure 4:
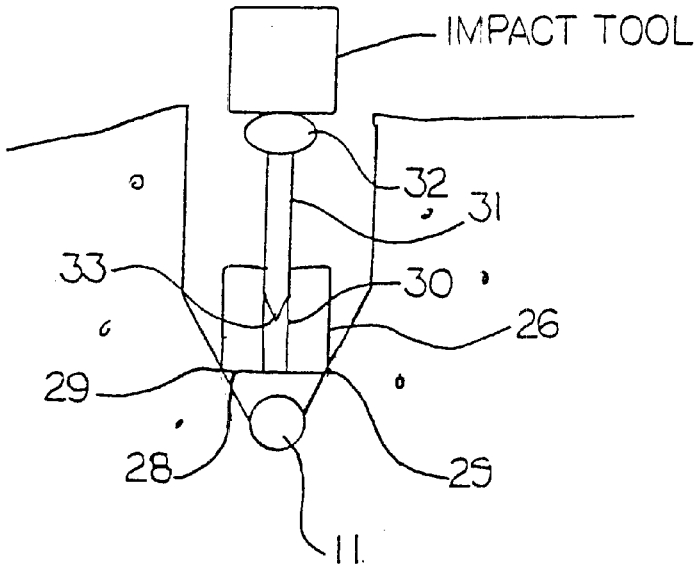
FIGS. 4, 5 and 6 are vertical cross sectional views showing consecutive steps in a method similar to but modified relative to that of FIG. 1.
Figure 5:
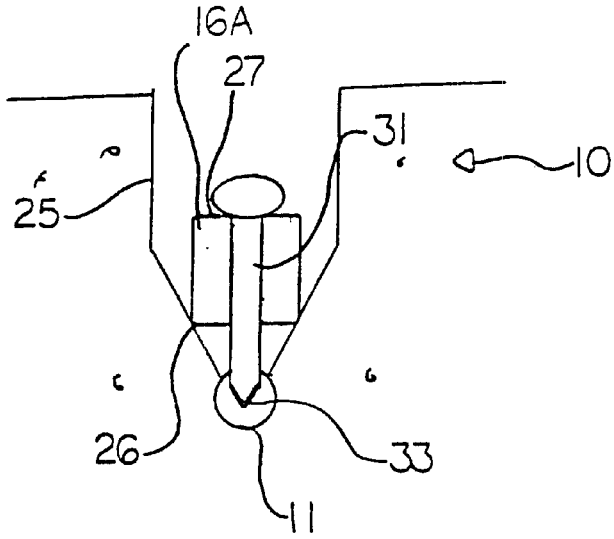
Figure 6:
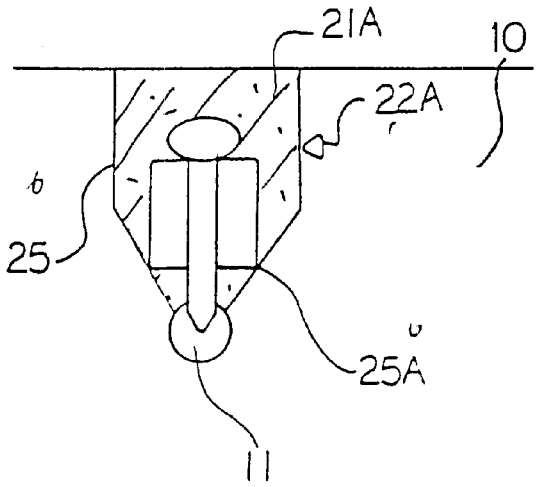
Figure 7:
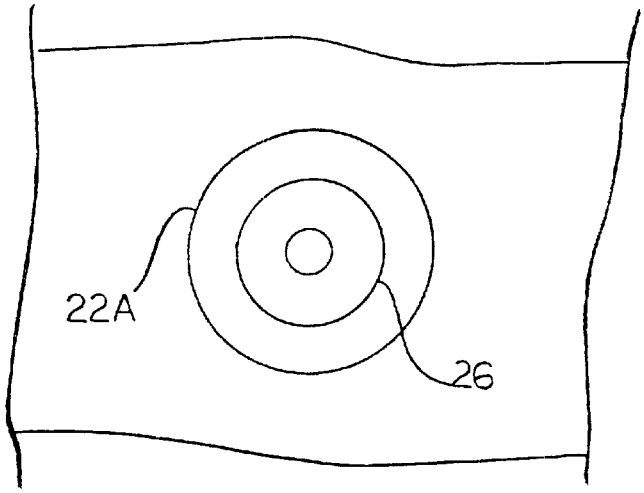
FIG. 7 is a top plan view of the embodiment of FIGS. 4, 5 and 6.

In FIGS. 1, 2 and 3 is shown a first embodiment according to the present invention of an improved cathodic protection device.

The device is of a similar construction to that shown in the above application WO94/29496, to which further reference may be made for further detail.

Thus the cathodic protection device is arranged for use in a concrete structure generally indicated at 10 having a reinforcing bar 11 embedded within the concrete and spaced from an upper surface 14 of the concrete. The present invention is primarily concerned with protection of the reinforcing bars buried in the concrete layer but also can advantageously be used to protect the buried portion of other steel members in the concrete such as supports for external attachments such as balustrades or hand rails where the steel members are only partially buried with a portion exposed beyond the concrete. Also the present invention is primarily concerned with concrete structures but some aspects, such as the anode construction, can also be used with other situations where a steel element is buried within a covering layer. The following description is directed to the primary use, but not sole use, with concrete structures.

Embedded within the concrete at a position adjacent to the reinforcing bar 11 is a cathodic protection device generally indicated at 15 which includes a puck-shaped anode body 16. The body 16 is preferably circular in plan view to define a circular upper surface 18 as shown in FIG. 3 and has a cylindrical peripheral surface 17 as shown in FIG. 1. Other shapes of the anode body can be provided if preferred but the puck is a convenient form in that it is relatively flat to allow insertion into the body of the concrete and it provides a sufficient volume of the anode material to avoid rapid depletion.

At diametrically opposed positions on the peripheral surface 17 is attached a pair of connecting wires 19 and 20 which are flexible but sufficiently stiff to be self-supporting. Any suitable electrically conductive material such as copper or most preferably steel can be used.

Around the anode body is provided a layer of a mortar material 21. In practice the mortar material is moulded around the puck so as to provide a thickness of a mortar material around the full periphery and on the top and bottom surfaces of the puck with the thickness being of the order of 1 cm. The wires 19 and 20 are electrically connected to the anode material and pass through the mortar.

The mortar forms an electrolyte which is in intimate communication with the concrete layer so that ions can flow between the anode and the steel reinforcement.

The mortar contains and supports also suitable materials to maintain the pH above 12 as described in the above application and preferably above 14 (the preferred value is approximately 14.5). As described in the above application, Portland cements of intrinsically higher alkali content (i.e. those containing relatively high proportions of $Na_2O$ and $K_2O$) can be used or other cements can be used with supplementary alkalis in the form of LiOH, NaOH or KOH for example. These materials are mixed into the mortar prior to the casting on the anode body.

In addition to the above materials, there is also applied into the mortar material a humectant or deliquescent material. Suitable materials include CaCl2, LiNO3, LiCl, MgCl2, Ca(SO4)2 and many others well known to one skilled in the art. Such humectant materials are basically in solid or powder form but can be dissolved to form an aqueous solution. When forming into the mortar, the material can be supplied in the powder form in admixture with the cement in required proportions and added to the mix water in conventional manner. Alternatively, the material can be supplied in aqueous solution where some or all of the water is supplied in the solution. However when admixed and the mortar sets, the humectant material is firmly bonded into the mortar material with the remaining materials set forth above. In all cases, therefore, the humectant or deliquescent material is carried in or bonded into the surrounding filler material and is not in a free flowing or liquid condition.

Other suitable humectant materials are set out in the above mentioned application of Bennett and Clear, to which reference may be made.

The filler material is preferably a solid so that it can contain and hold the anode without danger of being displaced during the process. The filler material preferably is relatively porous so that it can accommodate expansion of the anode material during oxidation (corrosion) of the anode. However voids which might fill with water should be avoided. A covering fabric such as felt can also be used to support the additive materials which are allowed to dry in the fabric pores.

The humectant material is thus selected so that it remains supported by and admixed into the mortar so that it does not significantly migrate out of the mortar during storage or in use.

The use of the protection device is substantially as described in the above application WO94/29496 in that it is buried in the concrete layer either at formation of the concrete in the original casting process or more preferably in a restoration process subsequent to the original casting. Thus sufficient of the original concrete is excavated as indicated at the dashed lines 22 to allow the reinforcing bar 11 to be exposed. The wires 19 and 20 are then wrapped around the reinforcing bar and the protective device placed into position in the exposed opening. The device is then covered by a recast portion of concrete and remains in place buried within the concrete.

This system is therefore generally applicable to a sacrificial anode system where the anode is buried within the concrete. In an alternative arrangement, not shown, the anode can form a pad applied onto the surface of the concrete with the filler material applied to and covering only one surface for contacting the concrete.

The cathodic protection device therefore operates in the conventional manner in that electrolytic potential difference between the anode and the steel reinforcing member causes a current to flow therebetween through the electrical connection and causes ions to flow therebetween through the concrete sufficient to prevent or at least reduce corrosion of the steel reinforcing bar while causing corrosion of the anode.

The level of the pH and the presence of the humectant enhances the maintenance of the current so that the current can be maintained for an extended period of time for example in a range 5 to 20 years.

The presence of the humectant material bound into the mortar layer acts to absorb sufficient moisture to maintain ion transfer around the anode to ensure that sufficient output current is maintained during the life of the anode and to keep the anode/filler interface electrochemically active. The presence also increases the amount of the current. Even though the mortar material 21 is not exposed to the atmosphere as it is buried within the concrete, and even though the humectant material is bound in fixed form into the mortar material, it has been found that absorption of moisture into the humectant material is sufficient to enhance the maintenance of the current output and to prevent premature reduction of output current over an extended period of operation and before the anode is consumed.

Figure 11:
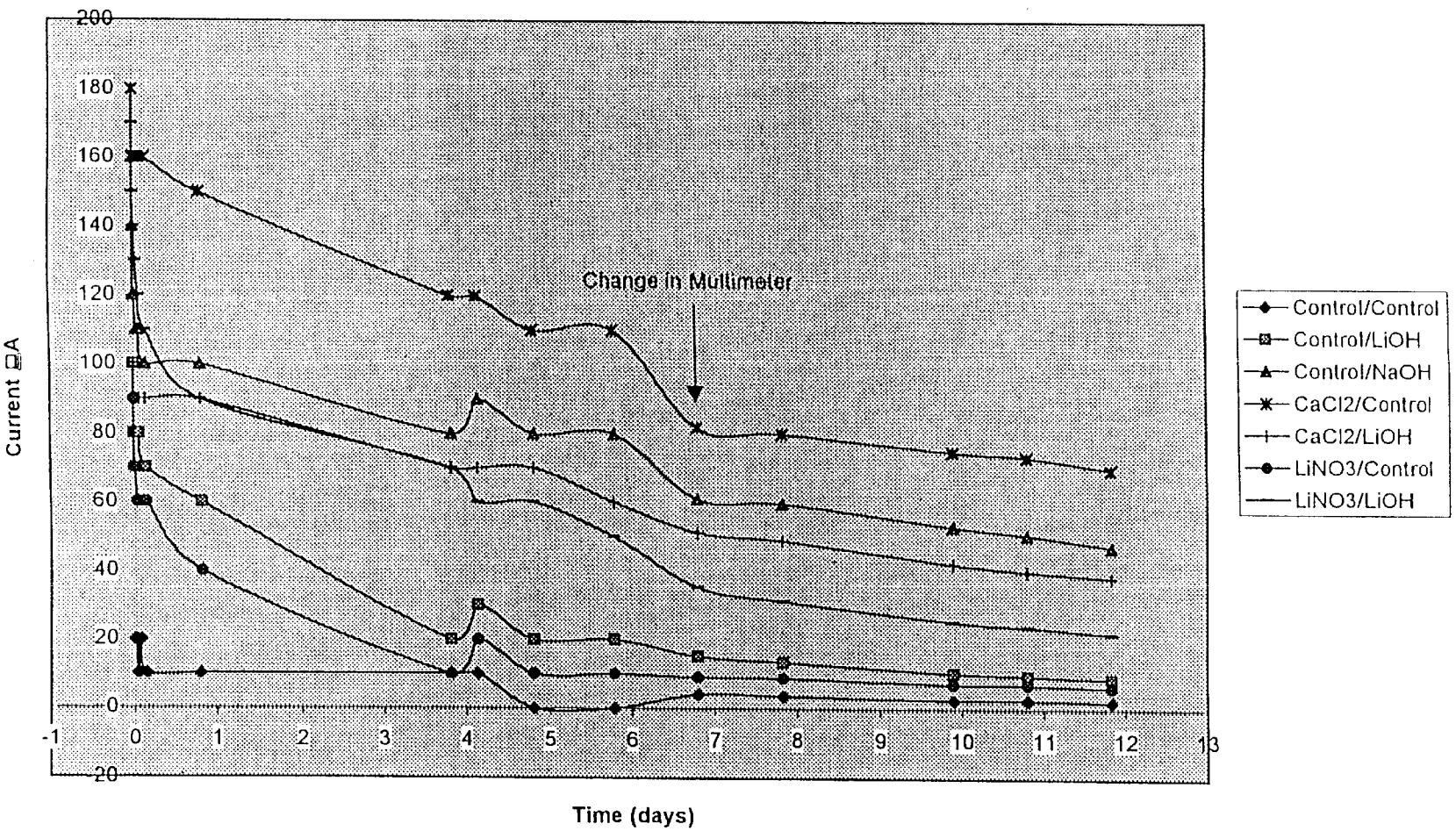
FIG. 11 is a graph showing the current developed by an anode system using different components in the filler material.

In FIG. 11 is shown a plurality of plots over time of current output for different additives in the mortar material. This shows that a significant increase is obtained in the current by using the humectant in the mortar both in combination with the alkali and without the alkali. While these observations are taken over only a relatively short time scale it can be reasonably predicted that the same advantages in current level will be maintained over an extended period of several years over the normal life of the anode.

Turning now to FIGS. 4 through 7, there is shown an alternative arrangement of the protective device according to the present invention.

Basically the protective device works in a similar manner to that described above in that there is an anode body formed of a suitable material of the required electric potential and that body is electrically connected to the reinforcing bar 11 of the concrete structure 10. The body may be also surrounded by a mortar material 21A containing the materials described above; but also the surrounding material may be omitted. In this arrangement the mortar material is not carried by the anode body 16A but instead is applied as a subsequent process as a filler to an opening 22A.

In this embodiment, therefore, the opening 22A is a drilled opening which is formed as a cylindrical hole 25 drilled into the concrete extending down to a base 29 which is sufficiently deep within the concrete structure 10 so as to expose an upper part of the reinforcing bar 11. It is not essential that the reinforcing bar be completely exposed at its upper surface but it is preferred to do so to ensure that the reinforcing bar has indeed been properly located and that the subsequent connection is properly applied to the reinforcing bar without the possibility of missing the reinforcing bar and leaving an open electrical connection.

In this arrangement, there is no necessity to expose the underside of the reinforcing bar to allow access to wrap around the reinforcing bar but only an upper surface of the reinforcing bar needs to be exposed. A drilled hole therefore can suffice and the drilled hole need only have a diameter sufficient to receive the body 16A to ensure the body is wholly contained within the concrete structure 10 after the mortar material 21A is inserted in place to fill the hole 22A.

In one example, the anode body 16A has a cylindrical outer surface 26, a circular top surface 27 and a circular bottom surface 28. Other shapes can also be adopted if preferred. In one arrangement, the anode body 16A includes a central longitudinal bore 30. The bore 30 co-operates with an attachment pin 31 having an upper head 32 and lower pointed end 33. Thus a kit of parts for assembling the structure would include a plurality of the anode bodies 16A and a plurality of the pins 31 for assembly into the drilled holes. The outside diameter of the pin 31 is slightly greater than the inside diameter of the hole 30 so that when driven through the hole 30, the pin is firmly engaged into the bore so that there is no possibility of the anode body becoming loose from the pin. The bore may be formed by drilling and insertion of the pin or more preferably by forming the body in place around the pin and the term "bore" used herein is not intended to be limited to drilling. In an alternative arrangement, the anode body may be pre-formed onto the pin as a rigid structure therewith and remains in place during the installation.

The length of the pin 31 is selected so that it will pass through the bore 30 to a position where the head 32 engages the top surface 27 at which time the pointed lower end 33 is engaged into the reinforcing bar 11.

Suitable impact tools are well-known in the construction industry for driving pins of this type into concrete and steel structures and such tools are well-known to one skilled in the art.

As shown in FIG. 4, therefore, with the anode body in place in the hole, the pin 31 is located at the top of the bore driven by the impact tool through the bore so that the lower end drives into the reinforcing bar and is attached thereto by cold forming of the reinforcing bar to provide a permanent physical attachment of the pin to the reinforcing bar.

Thus the pin stands vertically upwardly from the reinforcing bar and the anode body is held above the reinforcing bar by the pin. There is therefore no loose coupling and the attachment is entirely rigid so that it can not be disturbed during casting of the mortar material 21A or otherwise. The hole is shaped relative to the anode body so that the whole of the hole is filled with the filler material to prevent voids which can fill with water. In an alternative arrangement, not shown, the hole can be partly filled with the filler material which surrounds the anode body but not the complete hole, with the remainder of the hole being topped up with another filler which can simply be concrete.

As previously described, the mortar material contains the components necessary to enhance the maintenance of the electrolytic current between the anode body and the steel reinforcing bar. However in some arrangements the enhancing components may be omitted or replaced and the advantageous mounting of the anode body used as described above.

Figure 8:
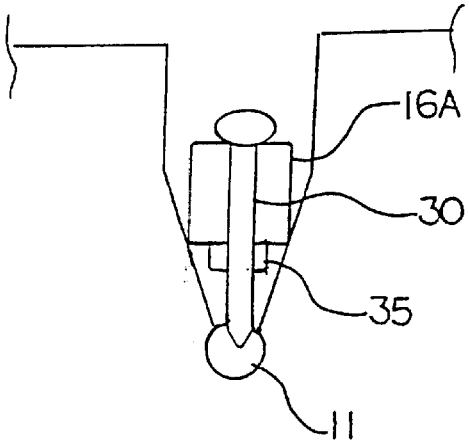
FIGS. 8, 9 and 10 are vertical cross sectional views showing three further methods similar to but modified relative to that of FIG. 1.
Figure 9:
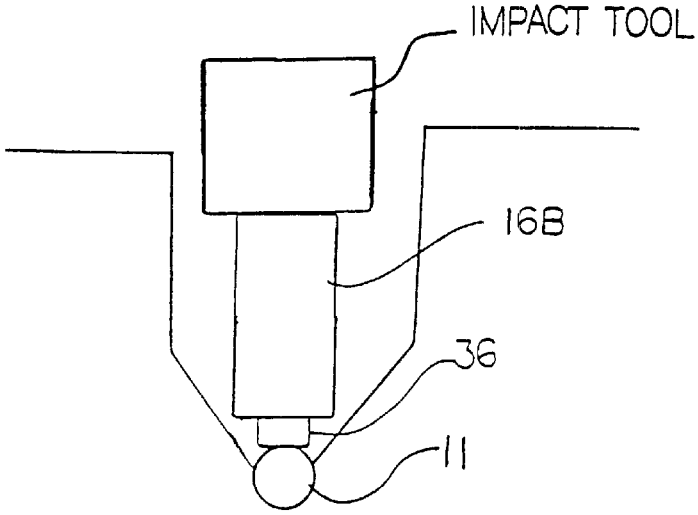
Figure 10:
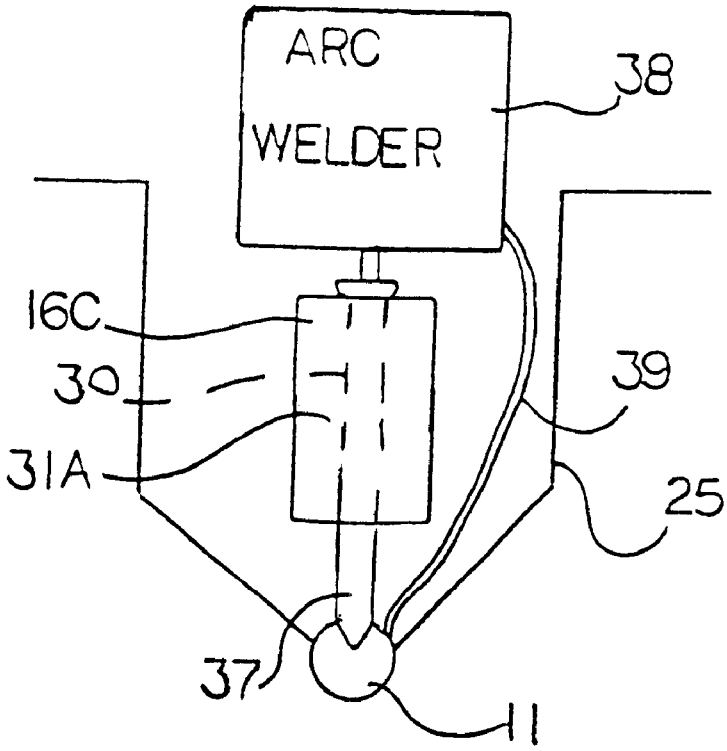

Turning now to FIGS. 8, 9 and 10, yet further modifications are shown which are related to the construction shown in FIGS. 4 through 7 but show further improvements which can be adopted if required.

The anode can be formed of any suitable material which is electronegative relative to the steel reinforcing members. Zinc is the preferred choice, but other materials such as magnesium, aluminum or alloys thereof can also be used.

In the embodiment of FIG. 8, the covering layer is omitted and instead the humectant and/or the alkali and/or other enhancement materials such as humectant or alkali as described hereinbefore are incorporated into the body of the anode. Thus the body is formed of a material as described above and the enhancement agent is incorporated into the structure by one of a number of available techniques. Preferably the agent is admixed during casting of the anode material as a mixture therewith. In an alternative arrangement, the materials of the anode and the agent can be divided and sintered or otherwise bonded together as a mixture.

Figure 14:
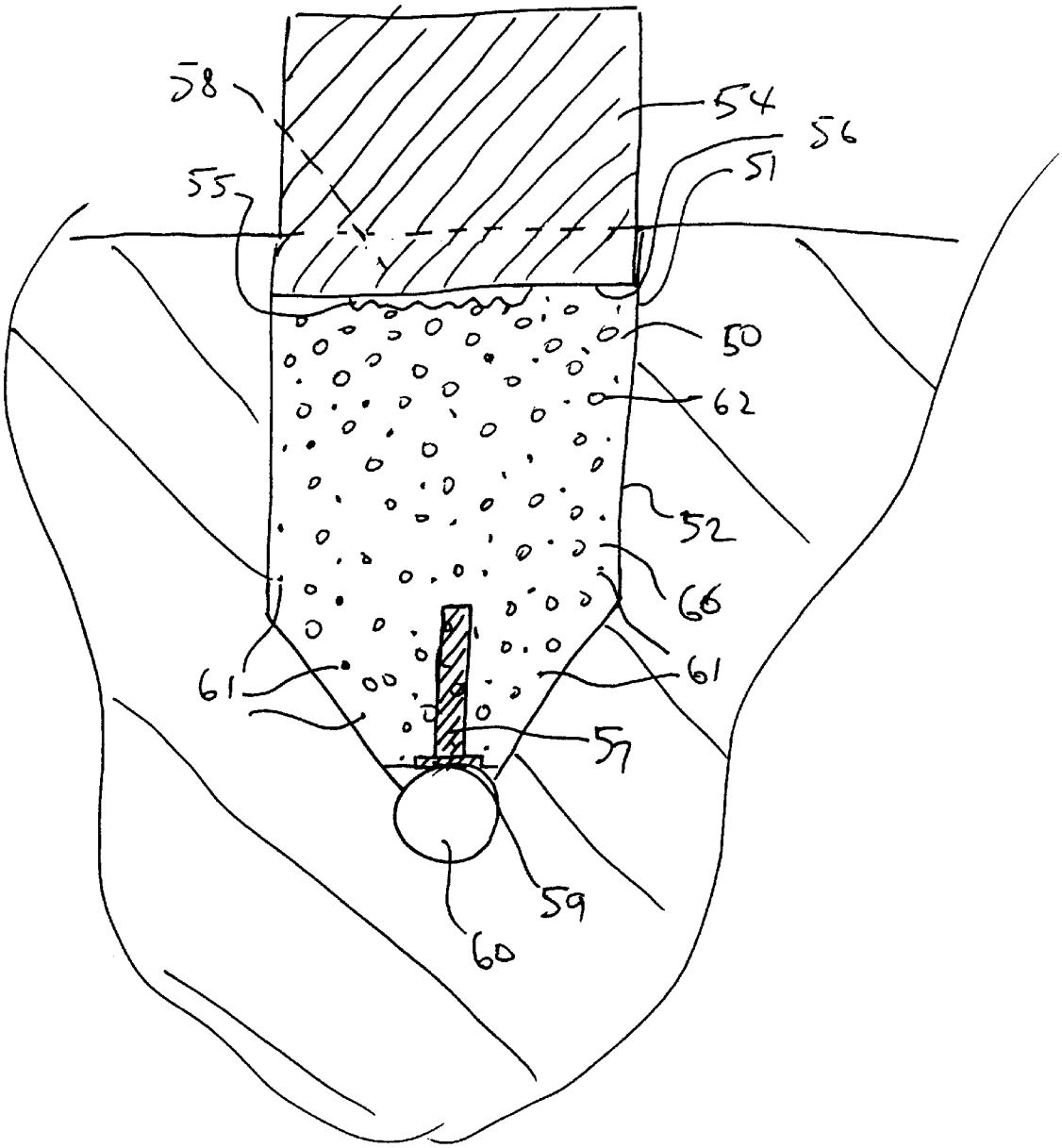
FIG. 14 is a vertical cross sectional view showing a further anode body structure installed in a drilled hole.

The enhancement material and the sacrificial anode material, such as zinc, can be pressed together to form a porous body as shown in FIG. 14. Simple pressure can be used to bind the materials together without the necessity for heat or sintering or a binder, although these also may be used. The anode material 66 can be in powder, shavings or granular form and mixed with the enhancement materials 61 in powder, crystalline or pellet form. Alternatively the anode material can be in wire or foil form and crumpled and compressed to reduce the voids. This arrangement has the advantage that the finished product is porous and that corrosion products from corrosion of the anode body during operation are received into the pores 62 of the porous body and thus avoid any expansion of the anode body which could cause cracking of the concrete. This is particularly effective when combined with the arrangement or FIG. 14 where the anode body is installed as a tight fit with the cylindrical wall of a drilled hole. This formation of the anode body to define pores can be used without the addition into the anode body of the enhancement material. Thus the discrete anode body in porous form, if formed without the enhancement material will be formed wholly of the metallic anode material 66. The formation and the degree of compression can be selected to generate a porous structure with sufficient pore size and number per unit volume that the whole of the corrosion products is taken up into the pores 62 thus avoiding any expansion of the body caused by the generation of the corrosion products. In addition this may allow the use of other materials such as aluminum or magnesium which are generally considered unsuitable because the corrosion products have a high increase in volume relative to the original metal thus causing severe cracking problems.

Figure 13:
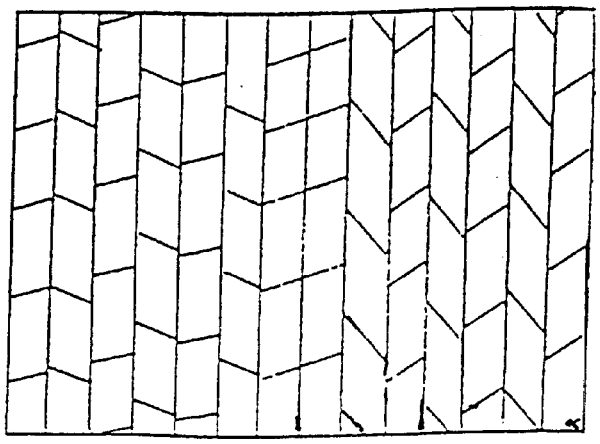
FIG. 13 is a vertical cross sectional view showing a further anode body structure similar to but modified relative to that of FIG. 1.

A yet further arrangement is shown in FIG. 13 wherein the anode material is supplied as a foil and the agent is supplied as a layer on one side of the foil which is then folded or rolled so as to form overlying layers of the material with the agent between such as a jellyroll or accordion folded structure. This arrangement provides a surface, such as the end surface of the jellyroll, on the anode body which is defined by the anode material with the agent directly available at the same surface.

Thus the humectant material is carried in a manner which allows a surface of the material of the anode body to communicate ions with the layer and which presents the agent at the same surface. Thus as that surface corrodes, the agent remains available at the surface to continue its action in enhancing the electrolytic effect. Thus the only effect of the agent occurs at the interface and it is of most value when available at the active surface.

Yet further alternative techniques can use the anode material in mesh form with the agent in the pores or openings or can use drilled or otherwise formed holes in the body to receive the agent.

This arrangement of providing the agent directly in the anode body allows the construction of an anode body which is of minimum dimensions thus allowing its installation in smaller locations or holes and thus allowing installation in locations where space is limited and thus reducing costs for forming the excavation to allow the installation.

In the embodiment of FIG. 8, the anode body 16A is enhanced by the addition of a supplementary body portion 35 of a different material. This body portion is formed of a metal which is of increased potential difference from the steel reinforcing bar relative to the main body of the anode, so that this anode body will provide an enhanced potential difference in an initial operating condition but the additional body will be consumed more quickly so that it becomes used up at an early stage. The additional body therefore provides a "kick start" to the process generating an initial high potential difference and then after it is consumed, the remaining process carries on through the use of the previously described anode body 16A.

In this arrangement, the additional body is applied simply in the form of a cylindrical washer at the lower end 27 of the body 16A so it can be applied in place and then the pin driven through the bore 30 and through a similar bore in the washer into the reinforcing bar 11 as previously described. The washer can thus be attached to the body 16A before use or can be a simple separate element. The washer can be applied at either end of the body on the pin and is held in place by the rigidity of the pin as previously described.

A further alternative is shown in FIG. 9 where the pin 30 is replaced by a deformable block 36 of a flowable metal such as lead. In this embodiment therefore the body 16B does not include a central bore but instead carries the lead block 36 on its lower end 27. The impact tool in this case therefore acts to drive a force through the body 16B into the flowable material block 36 so as to deform that material and bond it to the reinforcing bar 11 by the flowing action of the material.

In FIG. 10 is shown yet further alternative in which a pin 31A is provided already inserted through the body 16C. In this arrangement the hole 30 through the body 16C is arranged as a friction fit on the pin so that the pin is held in place without necessity for deformation of the body 16C. The pin thus has a lower end projecting downwardly from the underside of the body 16C and this lower end or tip 37 is welded to the upper surface of the reinforcing bar 11 by an arc welding system 38 of conventional type having a return wire 39 connected to the reinforcing bar generally at a separate location. Thus the electrical current through the pin 31A acts to weld the lower end of the pin to the reinforcing bar to provide a permanent fixed upstanding pin holding the anode body 16C accurately in place within the drilled hole 25.

In another alternative shown in FIG. 14, the anode member 50 is shaped as a sliding or tight fit within the drilled hole 51, thus it has a cylindrical outer surface 52 matching closely the diameter of the drilled hole. The anode member is then inserted into the hole either as a tight fit or it is expanded into a tight fit within the drilled hole by forces acting to drive the anode member into the hole. This can be done by impact forces or pressure from a tool 54 acting to drive the anode member into the hole. Alternatively the anode member can be expanded for example by an insert driven into the anode member. The anode member may be driven into place by the tool 54 which is shaped to match the top or exposed face but which includes a pattern 55 in relief which forms an embossed pattern in the face 56 of the anode body to confirm to the installer that sufficient force has been applied to drive the member to the required position and to bottom it against the rebar, and if necessary to expand the body to form a tight fit. The engagement of the outside surface of the anode body directly with the drilled surface of the existing concrete surprisingly provides sufficient electrical conductivity in use to ensure the cathodic protection.

In this arrangement, the anode member may include a rigid electrical connector in the form of a steel pin 57 or a flowable metal at its end adjacent the steel member and the rigid electrical connector is driven into connection with the steel member by the same forces.

In this way the anode body itself partly or wholly fills the drilled hole, preferably leaving a small volume 58 at the top of the hole to be filled by a cap of filler material simply for aesthetics and to prevent the escape of corrosion products.

In this arrangement, the anode body itself may be formed as a flowable metal allowing the forces to effect the lateral expansion to lock it in place in the hole.

This has the advantage that the product and its installation is very simple, with the anode material and the enhancement materials directly combined into the product itself.

The electrical connection from the anode material to the steel rebar is preferably provided by a material separate from the anode material itself such that its electrical connection is not lost or compromised during the corrosion. The connecting material is preferably steel. As the anode body in this arrangement is held in place by the frictional forces against the wall of the hole generated by the installation of the anode body, it is only necessary to ensure that the electrical connection is provided by a steel cap 59 or other material located or pinched between the bottom of the anode body and the steel rebar 60. This can be achieved by a multifilament wire (not shown) embedded in the anode body and splayed at the bottom of the anode body to be pinched by the steel rebar. It can also be provided by a steel cap which engages into or against the rebar. There is no need therefore for a mechanical interconnection between the connector and the rebar although this may also be provided for yet further ensuring electrical connection.

Figure 12:
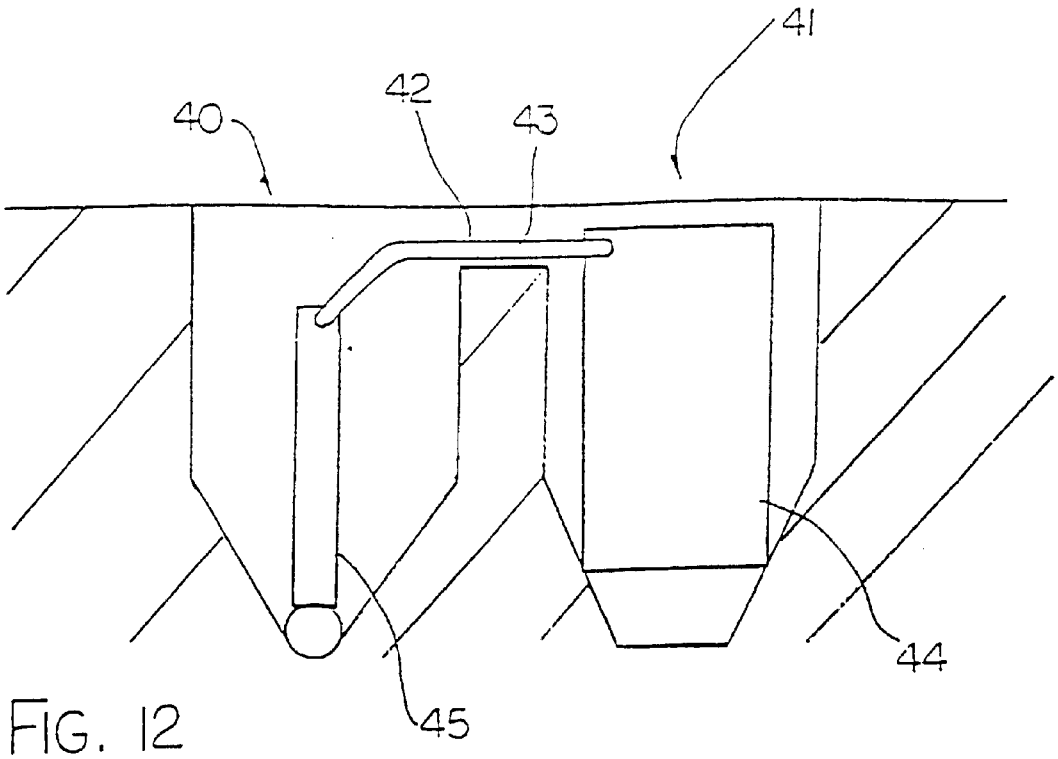
FIG. 12 is a vertical cross sectional view showing a further method similar to but modified relative to that of FIG. 1.

In FIG. 12 is shown another alternative arrangement which uses two drilled holes 40 and 41. In many concrete structures the reinforcing members are arranged at a depth of less than 2 inches which makes it difficult to provide an anode body which is sufficiently small to be received above the rebar and leave sufficient space for a filler material covering the anode body. The two hole arrangement thus allows a deeper second hole along side the rebar to receive and house the anode member and the first hole to receive a pin member which connects electrically to the rebar. The pin member uses one of the above techniques for attachment to the rebar. A small connecting groove 42 is formed between the drilled holes and a flexible conductor 43 attached to the anode 44 and to the pin member 45 passes through the groove. The drilled holes and the groove are filled as previously described. The anode can thus be installed in relatively small drilled holes and can be connected to the rebar to ensure effective electrical connection while having sufficient size to provide the required volume of sacrificial material for the required length of operating life.

In a further arrangement, a series of anode members can be installed each in its own hole with an electrical connection on the forma of a wire or the like passing from each to the next and connected to the rebar at one or more points in the structure. The electrical connection for all the anode members can be effected in one or more dedicated holes or by an end one or more of the anode members.

It will be appreciated that the effect of each anode is relatively localized so that the anodes must be installed in an array to provide protection for the whole reinforcing steel structure.

In an alternative arrangement (not shown), the anode can be covered or buried in a covering layer which is applied onto an existing layer of concrete. Thus the anode may be only partly buried in the original concrete or may be wholly outside the original concrete and thus may be covered by the new concrete applied. In this way, in some cases, no excavation or minimal excavation of the original material may be necessary. The additional concrete can be applied by attaching a suitable form, for example a jacket similar to that shown in U.S. Pat. No. 5,714,045 (Lasa et al) issued Feb. 3, 1998. The form shown in this patent is particularly designed for columns but other arrangements could be designed for other structures. The anode shown in this patent is replaced by the anodes disclosed hereinafter.

What is claimed is:

1. A method for cathodic protection comprising:

providing a covering material and a steel member at least partly embedded in the covering material;

providing a sacrificial anode body in the form of a solid body separate from the covering material;

at least partly embedding the anode body in the covering material;

electrically connecting the anode body to the steel member so that an electrical potential therebetween causes an electrical current to flow therebetween through the electrical connection and causes ions to flow through an interface of the anode body and through the covering material tending to inhibit corrosion of the steel member;

providing a material which is bound into the anode body with the sacrificial material thereof so as to be carried thereby which acts in the presence of moisture to communicate ions at the interface of the anode body to keep the interface electrochemically active during the life of the anode body to maintain said cathodic protection;

and providing in the material the characteristic of a humectant and causing the presence of the humectant material to absorb additional moisture sufficient to maintain conductivity at the interface to a level greater than would occur in the absence of the humectant material.

2. The method according to claim 1 wherein the anode body and the humectant material are formed of finely divided materials which are admixed and pressed together.

3. The method according to claim 1 wherein the anode body includes an alkali material bound therein with the humectant which provides a pH for the anode body greater than 12.

4. The method according to claim 1 wherein the anode body is formed of a sacrificial anode material which is arranged to define a porous body having pores therein and the method includes preventing expansion of the anode body during corrosion by arranging the pores in size and number such that corrosion products from corrosion of the anode body are received into the pores.

5. The method according to claim 1 wherein the anode body is formed of finely divided materials which are admixed together, pressed together and heated.

6. The method according to claim 1 including the steps of drilling a hole in the covering material so as to expose the steel member therein, inserting the anode body into the drilled hole and electrically connecting the anode body to the steel member in the hole.

7. The method according to claim 6 wherein the hole is drilled so that the steel member is exposed at the bottom of the hole with the hole extending from the steel member at the bottom to an open end into which the anode body is inserted and wherein the anode body is electrically connected to the steel member by forces on a face of the anode body from the open end of the hole.

8. The method according to claim 7 wherein the forces cause flow onto the steel member of a flowable metal portion.

9. The method according to claim 6 wherein the anode member includes an outer surface which is a tight fit within a wall of the drilled hole and is held in place at least partly by engagement of the outer surface with the wall of the hole.

10. The method according to claim 9 wherein the anode member includes an electrical connector at its end adjacent the steel member and the electrical connector is held in engagement with the steel member by the engagement of the outer surface of the anode member with the wall of the hole.

11. The method according to claim 1 wherein the anode body is electrically connected to the steel member by a solid pin rigidly attached to the anode body and engaging the steel member.

12. The method according to claim 11 wherein the pin has one end driven into the steel member by an impact tool.

13. The method according to claim 11 wherein the pin has one end electrically welded to the steel member.

14. The method according to claim 11 wherein the pin includes at least a portion extending into the anode body.

15. The method according to claim 1 including the steps of drilling a first and a second hole in the covering material so as to expose the steel member in the second drilled hole, inserting the anode body into the first drilled hole, providing a flexible electrical connection which extends from the anode body in the first hole to the steel member in the second hole, electrically attaching the electrical connection to the steel member and covering the electrical connection and the steel member in the second hole with a filler material.

16. A method for cathodic protection of a concrete structure comprising:

providing an existing concrete structure having a steel member and a layer of concrete covering the steel member so as to define a surface of the concrete layer spaced from the steel member;

providing a sacrificial anode member in the form of a solid body separate from the concrete layer;

forming at least one hole in the existing layer of concrete so as to expose a steel member therein;

inserting the anode member into the at least one hole;

and electrically connecting the anode member to the exposed steel member;

the anode body being electrically connected to the steel member so that an electrical potential therebetween causes an electrical current to flow therebetween through the electrical connection and causes ions to flow through the concrete layer tending to inhibit corrosion of the steel member;

wherein the at least one hole is formed by drilling and the anode member is shaped for insertion into the at least one drilled hole.

17. The method according to claim 16 including the steps of drilling a first and a second hole in the concrete layer so as to expose the steel member in the second drilled hole, inserting the anode body into the first drilled hole, providing a flexible electrical connection which extends from the anode body in the first hole to the steel member in the second hole, electrically attaching the electrical connection to the steel member and covering the electrical connection and the steel member in the second hole with a filler material.

18. The method according to claim 16 wherein the at least one hole comprises a single drilled hole drilled so that the steel member is exposed at the bottom of the hole with the hole extending from the steel member at the bottom to an open end and into which the anode body is inserted and wherein the anode body is electrically connected to the steel member by forces on a face of the anode body from the open end of the hole.

19. The method according to claim 18 wherein the anode member is electrically connected to the steel member by a solid pin rigidly attached to the anode body and to the steel member.

20. The method according to claim 19 wherein the pin has one end driven into the steel member by an impact tool.

21. The method according to claim 19 wherein the pin has one end electrically welded to the steel member.

22. The method according to claim 19 wherein the pin includes at least a portion extending into the anode body.

23. The method according to claim 16 wherein the anode member is rigidly attached to and electrically connected to the steel member by impact forces causing flow of a flowable metal portion.

24. The method according to claim 16 including providing an enhancement material for co-operating with the sacrificial anode material in enhancing the communication of ions between the concrete layer and the anode material, which material is bound into the sacrificial anode material of the solid anode body so as to be carried thereby.

25. An anode member for use in cathodic protection of a steel member in a covering material, the anode member comprising:

a solid anode body separate from the covering material formed by a sacrificial anode material;

the anode body being arranged for electrical connection of the anode body to the steel member;

and an enhancement material having the character that the enhancement material causes the presence of the enhancement material to communicate ions at the electrical interface of the anode body to keep the interface electrochemically active to ensure that sufficient current is maintained between the anode body and the steel member at a level greater than would occur in the absence of the enhancement material during the life of the anode body to maintain said cathodic protection, wherein the enhancement material is bound into the sacrificial anode material of the solid anode body so as to be carried thereby.

26. The anode member according to claim 25 wherein the enhancement material and the sacrificial anode material are combined together to form a porous body into pores of which are received corrosion products from corrosion of the anode body.

27. An anode member for use in cathodic protection of a steel member in a covering material, the anode member comprising:

a solid anode body separate from the covering material formed by a sacrificial anode material;

the anode body being arranged for electrical connection of the anode body to the steel member;

and a humectant material having the character that the humectant material causes the presence of the humectant material to communicate ions at the electrical interface of the anode body to keep the interface electrochemically active, wherein the humectant material is bound into the anode body with the sacrificial material thereof so as to be carried thereby;

and wherein the humectant material is arranged such that the presence of the humectant material acts to absorb sufficient moisture into the anode body to maintain conductivity around the anode body to a level greater than would occur in the absence of the humectant material.

28. An anode member for use in cathodic protection of a steel member in a covering material, the anode member comprising:

a solid anode body separate from the covering material formed by a sacrificial anode material;

the anode body being arranged for electrical connection of the anode body to the steel member;

and an alkali arranged to increase the pH of the anode body to a level greater than 12 bound into the solid anode body with the sacrificial anode material thereof so as to be carried thereby.

29. An anode member for use in cathodic protection of a steel member in a covering material, the anode member comprising:

a solid anode body separate from the covering material formed by a sacrificial anode material;

the anode body being arranged for electrical connection of the anode body to the steel member;

wherein the electrical connection includes a solid member rigidly connected with the anode body so as to be exposed at a bottom surface of the anode body, the solid member being arranged for rigid attachment to the steel member.

30. The anode member according to claim 29 wherein the solid member comprises a pin which has a bottom end arranged to be driven into the steel member by an impact tool.

31. The method according to claim 30 wherein the pin includes at least a portion extending into the anode body.

32. The anode member according to claim 30 wherein the solid member comprises a pin which has a bottom end arranged to be electrically welded to the steel member.

33. The anode member according to claim 29 wherein the solid member comprises a flowable metal portion arranged to secure the anode body within the hole by impact forces onto the anode body causing flow in the flowable metal portion.

34. The anode member according to claim 29 wherein the anode body has a cylindrical peripheral surface arranged to be inserted into a drilled hole.

35. The anode member according to claim 34 wherein the anode member includes an outer surface which is arranged to be a tight fit within a wall of the drilled hole and is arranged to be held in place at least partly by engagement of the outer surface with the wall of the hole.

36. The anode member according to claim 35 wherein the anode member includes an electrical connector at its end adjacent the steel member and the electrical connector is arranged to be held in engagement with the steel member by the engagement of the outer surface of the anode member with the wall of the hole.

37. The anode member according to claim 29 including an enhancement material for co-operating with the sacrificial anode material in enhancing the communication of ions between the covering material and the anode material wherein the enhancement material is bound into the sacrificial anode material of the solid anode body so as to be carried thereby.

38. A method for cathodic protection comprising:

providing a covering material and a steel member at least partly embedded in the covering material;

providing a sacrificial anode member in the form of a solid body separate from the covering material;

embedding the anode body in the covering material;

and electrically connecting the anode member to the steel member;

the anode body being electrically connected to the steel member so that an electrical potential therebetween causes an electrical current to flow therebetween through the electrical connection and causes ions to flow through the covering material tending to inhibit corrosion of the steel member wherein the anode body is formed of a sacrificial anode material which is arranged to define a porous body having pores therein;

and preventing expansion of the anode body during corrosion by arranging the pores in size and number such that corrosion products from corrosion of the anode body are received into the pores.

39. A method for cathodic protection comprising:

providing a covering material and a steel member at least partly embedded in the covering material;

providing a sacrificial anode body in the form of a solid body separate from the covering material;

forming at least one hole in the covering material by drilling into the covering material so as to expose a steel member therein;

inserting the anode member into the at least one drilled hole;

wherein the anode member includes an outer surface which is a tight fit within a wall of the drilled hole and is held in place at least partly by engagement of the outer surface with the wall of the hole;

and electrically connecting the anode body to the steel member so that an electrical potential therebetween causes an electrical current to flow therebetween through the electrical connection and causes ions to flow through an interface of the anode body and through the covering material tending to inhibit corrosion of the steel member.

40. The method according to claim 39 wherein the anode member includes an electrical connector at its end adjacent the steel member and the electrical connector is held in engagement with the steel member at least partly by the engagement of the outer surface of the anode member with the wall of the hole.

41. The method according to claim 39 wherein the anode body is formed of finely divided materials which are pressed together.

42. The method according to claim 39 wherein the anode body is formed of finely divided materials which are pressed together and heated.

43. The method according to claim 39 wherein the anode body is formed of a sacrificial anode material which is arranged to define a porous body having pores therein and the method includes preventing expansion of the anode body during corrosion by arranging the pores in size and number such that corrosion products from corrosion of the anode body are received into the pores.

44. A method for cathodic protection comprising:

providing a covering material and a steel member at least partly embedded in the covering material;

providing a sacrificial anode body in the form of a solid body separate from the covering material;

electrically connecting the anode body to the steel member so that an electrical potential therebetween causes an electrical current to flow therebetween through the electrical connection and causes ions to flow through an interface of the anode body and through the covering material tending to inhibit corrosion of the steel member;

and providing an alkali material which is bound into the anode body with the sacrificial material thereof so as to be carried thereby which provides a pH for the anode body greater than 12.

45. The method according to claim 44 wherein the anode body is formed of finely divided materials which are pressed together.

46. The method according to claim 44 wherein the anode body is formed of finely divided materials which are pressed together and heated.

47. The method according to claim 44 wherein the anode body is formed of a sacrificial anode material which is arranged to define a porous body having pores therein and the method includes preventing expansion of the anode body during corrosion by arranging the pores in size and number such that corrosion products from corrosion of the anode body are received into the pores.

48. A method for cathodic protection comprising:

providing a covering material and a steel member at least partly embedded in the covering material;

providing a sacrificial anode body in the form of a solid body separate from the covering material;

electrically connecting the anode body to the steel member so that an electrical potential therebetween causes an electrical current to flow therebetween through the electrical connection and causes ions to flow through an interface of the anode body and through the covering material tending to inhibit corrosion of the steel member;

wherein the anode body is formed of finely divided materials which are pressed together.

49. The method according to claim 48 wherein the anode body is formed of finely divided materials which are pressed together and heated.

50. The method according to claim 48 wherein the anode body is formed of a sacrificial anode material which is arranged to define a porous body having pores therein and the method includes preventing expansion of the anode body during corrosion by arranging the pores in size and number such that corrosion products from corrosion of the anode body are received into the pores.

* * * * *